US011217918B2

(12) United States Patent
Vana, Jr. et al.

(10) Patent No.: US 11,217,918 B2
(45) Date of Patent: Jan. 4, 2022

(54) ELECTRICAL CABLE

(71) Applicant: 3M INNOVATIVE PROPERTIES COMPANY, St. Paul, MN (US)

(72) Inventors: James G. Vana, Jr., Cedar Park, TX (US); Alexander W. Barr, Austin, TX (US); Richard J. Scherer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/317,885

(22) PCT Filed: Jul. 19, 2017

(86) PCT No.: PCT/US2017/042833

§ 371 (c)(1),
(2) Date: Jan. 15, 2019

(87) PCT Pub. No.: WO2018/022379

PCT Pub. Date: Feb. 1, 2018

(65) Prior Publication Data

US 2019/0296465 A1 Sep. 26, 2019

Related U.S. Application Data

(60) Provisional application No. 62/367,844, filed on Jul. 28, 2016.

(51) Int. Cl.
*H01R 12/62* (2011.01)
*H01R 12/59* (2011.01)
(Continued)

(52) U.S. Cl.
CPC ..... *H01R 12/62* (2013.01); *H01R 12/592* (2013.01); *H01R 12/594* (2013.01);
(Continued)

(58) Field of Classification Search
CPC .. H01R 12/53; H01R 12/5559; H01R 12/592; H01R 12/594; H01R 12/598;
(Continued)

(56) References Cited

U.S. PATENT DOCUMENTS 3,553,632 A * 1/1971 Hildebrand et al. ..... H01R 13/4367 439/634
4,085,502 A * 4/1978 Ostman ..... H01B 7/08 156/55
(Continued)

FOREIGN PATENT DOCUMENTS

DE 102010039185 A1 * 2/2012 ..... H01R 12/778
EP 0366046 5/1990
(Continued)

OTHER PUBLICATIONS

Araujo, "Full-Wave, TwinAx, Differential Cable Modeling", Electronic Components and Technology Conference 2008, pp. 1684-1689.
(Continued)

*Primary Examiner* — Paresh H Paghadal
(74) *Attorney, Agent, or Firm* — Clifton F. Richardson

(57) ABSTRACT

An electrical cable (1000) including a plurality of substantially parallel insulated conductors (100) is described. Each insulated conductor (100) includes an electrically conductive inner conductor (200) co-extensive and covered with an insulating layer (300). At least a portion of a periphery of each insulated conductor (100) may be encompassed by a substantially co-extensive electrically conductive shield (400). For each insulated conductor (100), portions of the insulating layer (300) are removed from the top side (1200) of the cable (1000) to expose a portion of the inner conductor (200) of the insulated conductor (100). The insulated conductor (100) is adapted to mate with an electrically
(Continued)

conductive mating conductor (500) at the exposed portion (210) of the inner conductor (200).

10 Claims, 6 Drawing Sheets

(51) Int. Cl.
*H01R 12/65* (2011.01)
*H01B 11/20* (2006.01)

(52) U.S. Cl.
CPC ..... *H01R 12/598* (2013.01); *H01B 11/203* (2013.01); *H01R 12/65* (2013.01)

(58) Field of Classification Search
CPC ..... H01R 12/62; H01R 12/65; H01B 11/203; H01B 7/0861; H01B 7/0869; H01B 7/106; H01B 7/08; H01B 7/17; A61B 1/0114; A61B 1/0124
See application file for complete search history.

(56) References Cited

U.S. PATENT DOCUMENTS 4,375,379 A * 3/1983 Luetzow ..... H01B 7/0838 156/292
4,873,411 A * 10/1989 Saen ..... B23K 11/14 219/93
5,147,510 A * 9/1992 Iura ..... H01R 12/592 174/117 A
5,360,944 A * 11/1994 Springer ..... H01B 7/0838 174/102 R
5,879,285 A * 3/1999 Ishii ..... A61B 1/00167 600/110
6,055,722 A * 5/2000 Tighe ..... H01R 12/62 29/839
6,341,980 B1 * 1/2002 Hio ..... H01R 12/68 439/422
6,394,816 B1 * 5/2002 Watanabe ..... H05K 3/325 439/595
6,490,169 B1 * 12/2002 Watanabe ..... H01R 12/79 174/250
6,531,658 B2 * 3/2003 Tanaka ..... H01B 7/0861 174/117 F
6,977,344 B2 * 12/2005 Tanaka ..... H01B 7/0861 174/117 F
8,076,591 B2 * 12/2011 Agnew ..... H05K 1/0218 174/255
8,888,504 B2 * 11/2014 Pischler ..... H01L 24/10 439/74
9,064,612 B2 6/2015 Gundel
9,190,769 B2 * 11/2015 Nonen ..... H01R 13/5829
9,263,173 B2 * 2/2016 Prat ..... H01B 3/14
10,090,612 B2 * 10/2018 Benedict ..... H01B 7/0823
2001/0035297 A1 * 11/2001 Tamai ..... H01B 7/0009 174/133 R
2001/0050184 A1 * 12/2001 Adachi ..... H01R 4/02 174/268
2002/0084088 A1 * 7/2002 Tanaka ..... H01B 7/0861 174/36
2003/0000730 A1 * 1/2003 Kwok ..... H01R 12/79 174/117 F
2004/0055784 A1 * 3/2004 Joshi ..... B23K 1/0008 174/254
2004/0147992 A1 * 7/2004 Bluger ..... A61N 1/0541 607/116
2007/0193770 A1 * 8/2007 Ueno ..... H01B 7/0861 174/117 FF
2007/0218781 A1 * 9/2007 Yokai ..... H05K 3/363 439/752
2009/0120662 A1 * 5/2009 Tanaka ..... H01R 13/5833 174/113 R
2010/0037457 A1 * 2/2010 Norlin Weissenrieder ..... H01B 13/00 29/882
2010/0037458 A1 * 2/2010 Ranz ..... B23P 15/006 29/889
2011/0042140 A1 * 2/2011 Nakamura ..... H01R 12/62 174/84 R
2011/0139500 A1 * 6/2011 Hara ..... H01R 12/62 174/259
2012/0037403 A1 * 2/2012 Liskow ..... H05K 3/368 174/251
2012/0064762 A1 * 3/2012 Muroi ..... H01R 9/038 439/578
2013/0225004 A1 * 8/2013 Behziz ..... H05K 3/325 439/656
2013/0280955 A1 * 10/2013 Alden, III ..... H01R 13/648 439/607.28
2014/0326857 A1 * 11/2014 Sekido ..... H01L 27/14636 250/208.1
2016/0093991 A1 * 3/2016 Kobayashi ..... H01R 24/38 439/579
2017/0005424 A1 * 1/2017 Lee ..... H01R 12/778
2017/0025769 A1 * 1/2017 Tokunaga ..... H01R 4/188
2017/0064829 A1 * 3/2017 Ohtsu ..... H01R 12/62
2017/0221602 A1 * 8/2017 Bihler ..... H02G 1/14
2018/0005730 A1 * 1/2018 Huber ..... H01B 11/02

FOREIGN PATENT DOCUMENTS

EP 1164661 12/2001
JP 11273459 10/1999
JP 2003-143728 5/2003
JP 2003-229030 8/2003
JP 2008-098560 4/2008
JP 2010-272400 12/2010
JP 2011045173 A * 3/2011 ..... H01R 9/0515
JP 2011-187290 9/2011
JP 2015-144102 8/2015
KR 10-2016-0041801 4/2016
WO WO 2002-020686 3/2002
WO WO 2006-017037 2/2006
WO WO 2016-178861 11/2016

OTHER PUBLICATIONS

"Paricon® Overview", Paricon® Technologies Corporation, Fall River, MA, date unknown but believed to be prior to the date of the filing of the present application, 57 pages.
"ZIF/LIF connectors for direct connection of FFC/FPC FH Series", Hirose U.S.A., Downers Grove, IL, date unknown but believed to be prior to the date of the filing of the present application, 26 pages.
International Search Report for PCT International Application No. PCT/US2017/042833, dated Dec. 20, 2017, 8 pages.

* cited by examiner

ELECTRICAL CABLE

BACKGROUND

Electrical cables may have an end portion entirely stripped of insulation and shielding materials in order to bond with a circuit board.

SUMMARY

In some aspects of the present description, an electrical cable including a plurality of substantially parallel insulated conductors extending along a length direction of the cable is provided. Each insulated conductor includes an electrically conductive inner conductor covered with an insulating layer, such that when the electrical cable is laid flat defining opposing major top and bottom sides of the cable, for at least one insulated conductor in the plurality of insulated conductors, a longer first portion of the inner conductor of the at least one insulated conductor is exposed on the top side of the cable, and a shorter second portion of the inner conductor of the at least one insulated conductor is exposed on the bottom side of the cable. The longer first portion at least partially overlaps the shorter second portion. The inner conductor is adapted to mate with an electrically conductive mating conductor at the exposed longer first portion of the inner conductor.

In some aspects of the present description, an electrical cable including a plurality of substantially parallel insulated conductors extending along a length direction of the cable is provided. Each insulated conductor includes an electrically conductive inner conductor covered with an insulating layer. At least 70% of a periphery of each insulated conductor is encompassed by a substantially co-extensive electrically conductive shield. When the electrical cable is laid flat defining opposing major top and bottom sides of the cable, for each insulated conductor, portions of the insulating layer and the conductive shield are removed from the top side of the cable to expose a portion of the inner conductor of the insulated conductor, such that from a top plan view, an average lateral width of the exposed portion of the inner conductor is less than an average lateral width of the inner conductor. The exposed portion of the inner conductor includes a first end of the inner conductor on a same first end of the cable. The insulated conductor is adapted to mate with an electrically conductive mating conductor at the exposed portion of the inner conductor.

In some aspects of the present description, an electrical cable including a plurality of substantially parallel insulated conductors extending along a length direction of the cable is provided. Each insulated conductor includes an electrically conductive inner conductor co-extensive and covered with an insulating layer, and an electrically conductive shield substantially co-extensive with and surrounding each insulated conductor. When the electrical cable is laid flat defining opposing major top and bottom sides of the cable, for each insulated conductor, portions of the insulating layer and the conductive shield are removed from the top side of the cable to expose a portion of the inner conductor of the insulated conductor, such that from a top plan view, an average lateral width of the exposed portion of the inner conductor is less than an average lateral width of the inner conductor. The exposed portion of the inner conductor includes a first end of the inner conductor on a same first end of the cable. The insulated conductor is adapted to mate with an electrically conductive mating conductor at the exposed portion of the inner conductor.

In some aspects of the present description an electrical cable assembly including the electrical cable attached to a circuit board is provided.

DETAILED DESCRIPTION

In the following description, reference is made to the accompanying drawings that forms a part hereof and in which various embodiments are shown by way of illustration. The drawings are not necessarily to scale. It is to be understood that other embodiments are contemplated and may be made without departing from the scope or spirit of the present disclosure. The following detailed description, therefore, is not to be taken in a limiting sense.

Circuit boards are often electrically connected to another electrical component using an electrical cable which includes a plurality of parallel insulated conductors. Conventionally, the electrical cable is stripped at an end of the cable and the conductors in the cable are attached to solder pads on the circuit board. When the cable is shielded, this stripping removes the shielding and insulation from the entire end portions of the conductors. According to the present description, it has been found that stripping the entire end portions of the conductors causes increased crosstalk near the termination area and an impedance mismatch which degrade signal transmission performance and can result in higher return loss and lower bandwidth or data rate, and that this crosstalk and impedance mismatch can be substantially reduced by leaving the insulation and shielding, if included in the cable, at least partially intact on one side of the cable. This can be achieved by using a razor blade, for example, to remove the shielding and insulation from one side of an end portion of the cable. The razor blade can used to cut into the cable at a shallow angle so that is cuts through shielding and insulation without cutting into conductors. Keeping the lower portion of the insulation intact can aid in making a connection to a circuit board since the insulation keeps the conductors aligned at the desired pitch for making the connection.

Figure 1:
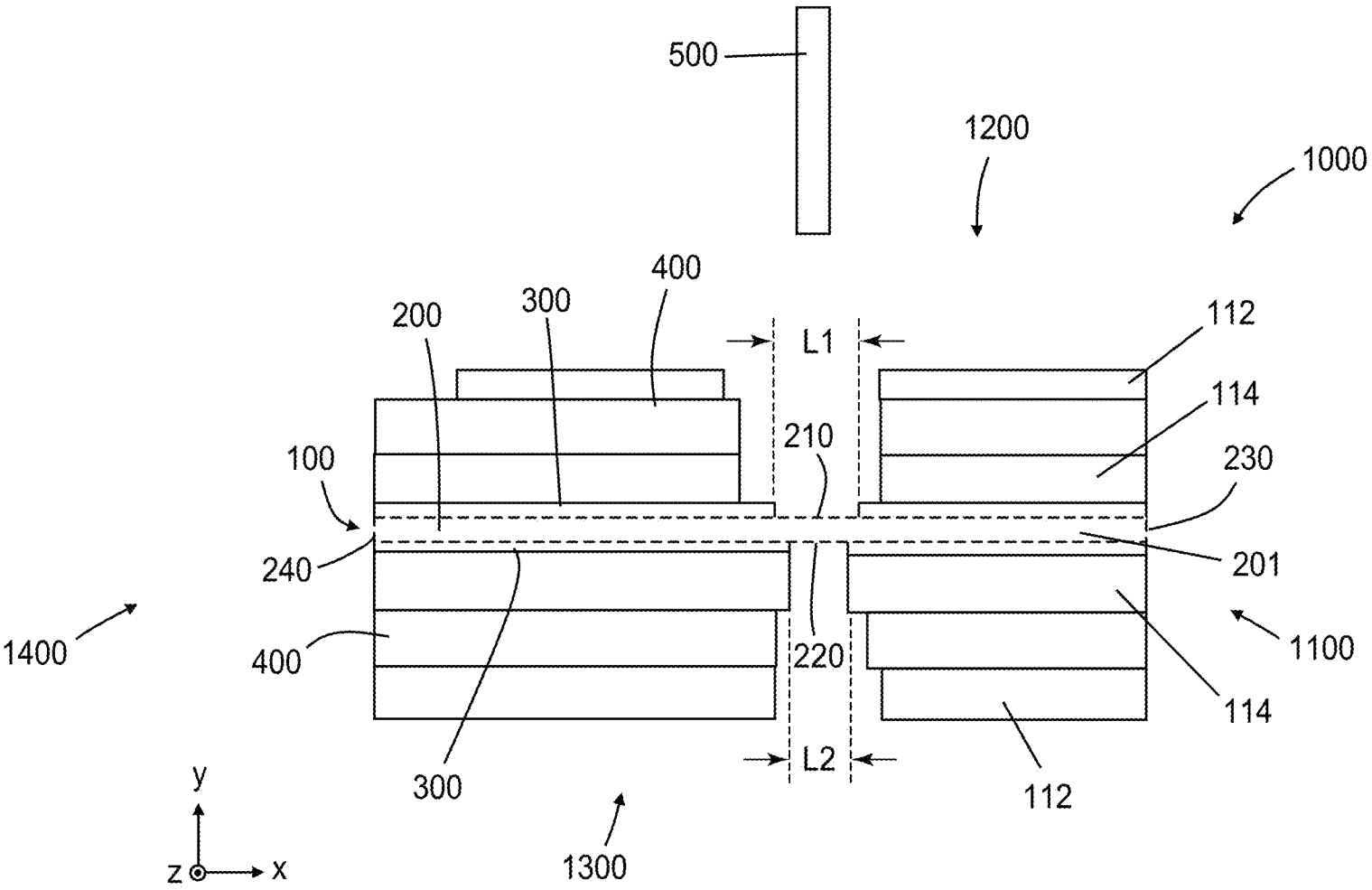
FIG. 1 is a schematic cross-sectional side view of an electrical cable.

FIG. 1 is a schematic cross-sectional side view of an electrical cable 1000 including a plurality of substantially parallel insulated conductors 100 extending along a length direction (x-direction, referring to the x-y-z coordinate system of FIG. 1) of the cable 1000. Each insulated conductor 100 includes an electrically conductive inner conductor 200 covered with an insulating layer 300. Opposing major top and bottom sides 1200 and 1300 of the electrical cable 1000 are defined by laying the cable 1000 flat. For at least one insulated conductor 201 in the plurality of insulated conductors 100, a longer first portion 210 of the inner conductor 200 of the at least one insulated conductor 201 is exposed on the top side 1200 of the cable, and a shorter second portion 220 of the inner conductor 200 of the at least one insulated conductor 201 is exposed on the bottom side 1300 of the cable. The longer first portion 210 at least partially overlaps the shorter second portion 220. The inner conductor 200 is adapted to mate with an electrically conductive mating conductor 500 at the exposed longer first portion 210 of the inner conductor 200.

In the illustrated embodiment, the electrical cable 1000 further includes an electrically conductive shield 400. In some embodiments, the electrically conductive shield 400 is substantially co-extensive with and surrounds each insulated conductor 100. In some embodiments, at least 70% of a periphery of each insulated conductor 100 is encompassed by the electrically conductive shield 400.

The longer first portion 210 has a length L1 which may be, for example, at least 0.5 mm, or at least 1 mm long, or may be in a range of 0.5 mm to 30 mm. The shorter second portion 220 has a length L2 which may be, for example, less than 0.5 mm. In some embodiments, the longer first portion 210 fully overlaps the shorter second portion 220. In some embodiments, the shorter second portion 220 is absent and the length L2 is zero. The first and second portions 210 and 220 can be exposed using a razor blade to strip insulating layer 300, and other layers such as the electrically conductive shield 400, from the inner conductor 200.

The at least one insulated conductor 201 extends along the length direction (x-direction) of the cable between opposite ends (first and second ends 230 and 240) of the at least one insulated conductor 201. In the embodiment illustrated in FIG. 1, the exposed longer first portion 210 is between the opposite first and second ends 230 and 240. In other embodiments, the exposed longer first portion 210 of the at least one insulated conductor 201 comprises one of the first and second ends 230 and 240 (see, e.g., FIG. 4A). In some embodiments, the at least one insulated conductor 201 extends along the length direction (x-direction) of the cable between a first end 230 of the at least one insulated conductor 201 at a same first end 1100 of the cable 1000 and an opposite second end 240 of the at least one insulated conductor 201 at a same opposite second end 1400 of the cable 1000. In some embodiments, the exposed longer first portion 210 of the at least one insulated conductor 201 comprises the first end 230 of the at least one insulated conductor 201 (see, e.g., FIG. 4A).

Electrical cable 1000 includes layer 114 between electrically conductive shield 400 and insulating layer 300 and includes electrically insulating jacket 112 adjacent the electrically conductive shield 400 opposite the insulated conductors 100. The layer 114, which may include one or more sublayers, may be or may include one or more of an insulating substrate and an adhesive layer. The insulating jacket 112 may also include one or more sublayers, and may be or may include one or more of an insulating substrate and an adhesive layer. In some embodiments, the insulating jacket 112 is wrapped longitudinally around the electrically conductive shield 400. In some embodiments, the insulating jacket 112 covers all or substantially all of the electrically conductive shield 400. In some embodiments the electrically conductive shield 400 comprises two shielding films, one disposed adjacent first side 1200 and the other disposed adjacent second side 1300. The two shielding films may be attached along edges of the shielding film. In some embodiment, the electrically conductive shield 400 includes separate portions which partially or completely surround one or more of the insulated conductors 100.

Figure 2:
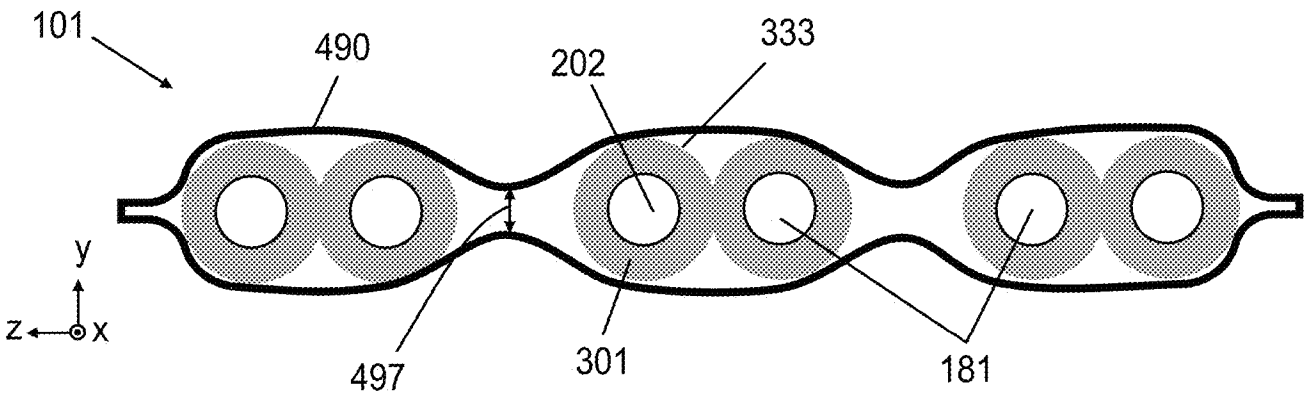
FIGS. 2-3 are schematic cross-sectional end views of electrical cables.

FIG. 2 is a schematic cross-sectional view of electrical cable 101 including a plurality of substantially parallel insulated conductors 181 and including electrically conductive shield 490. Each insulated conductor in the plurality of insulated conductors 181 includes an inner conductor 202 and an insulating layer 301 having a periphery 333. In some embodiments, the electrically conductive shield 490 surrounds at least a majority of the periphery 333 of the plurality of insulated conductors 181. For example, in some embodiments, at least 70%, or at least 80%, or at least 90%, of the periphery 333 of each insulated conductor is encompassed by the electrically conductive shield 490. In the illustrated embodiment, not all of the periphery 333 is encompassed by the electrically conductive shield 490 due to the spacing 497. As this spacing is reduced, a larger percentage of the periphery 333 is encompassed by the electrically conductive shield 490. In some embodiments, electrical cable 101 further includes an insulating jacket substantially covering the electrically conductive shield 490 which may or may not conform to the shape of the electrically conductive shield 490. In some embodiments, an insulating jacket is extruded over the electrically conductive shield 490. In some embodiments, electrically conductive shield 490 is laminated between two insulating substrates and the outer insulating substrate is an insulating jacket for the electrical cable 101.

Figure 3:
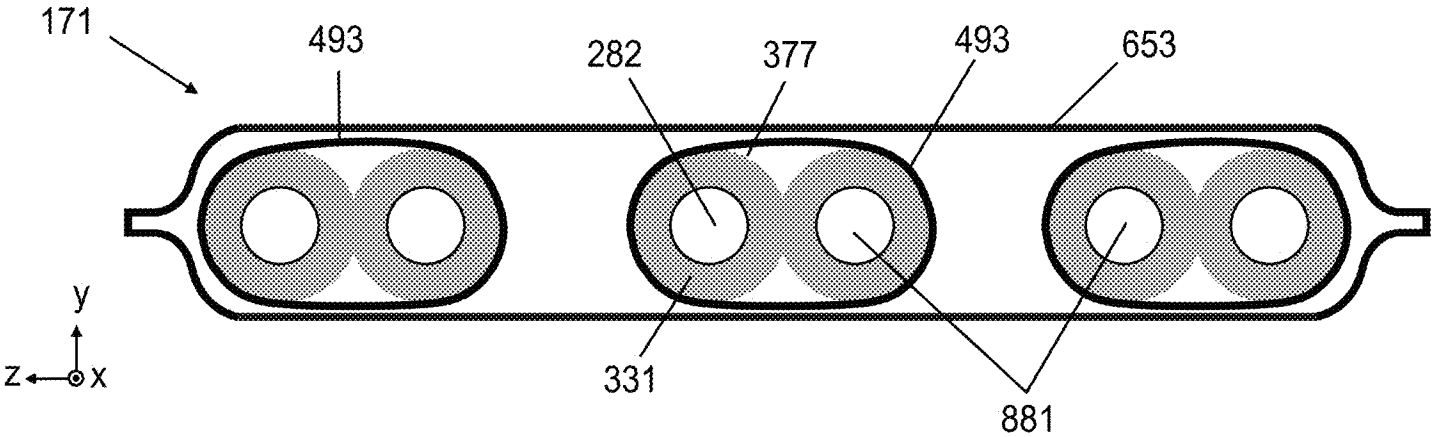
Figure 4A:
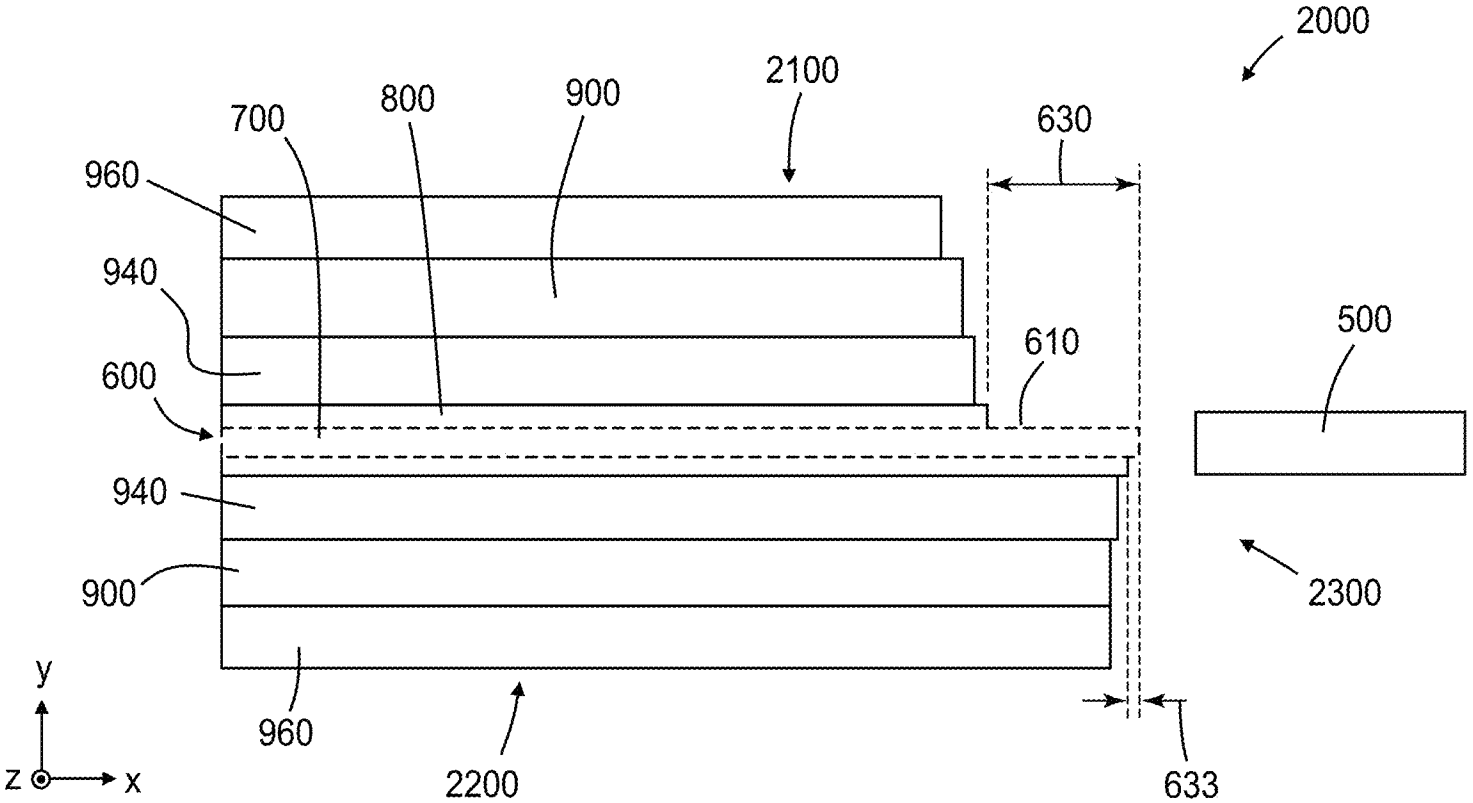
FIG. 4A is a schematic cross-sectional side view of an electrical cable.
Figure 4B:
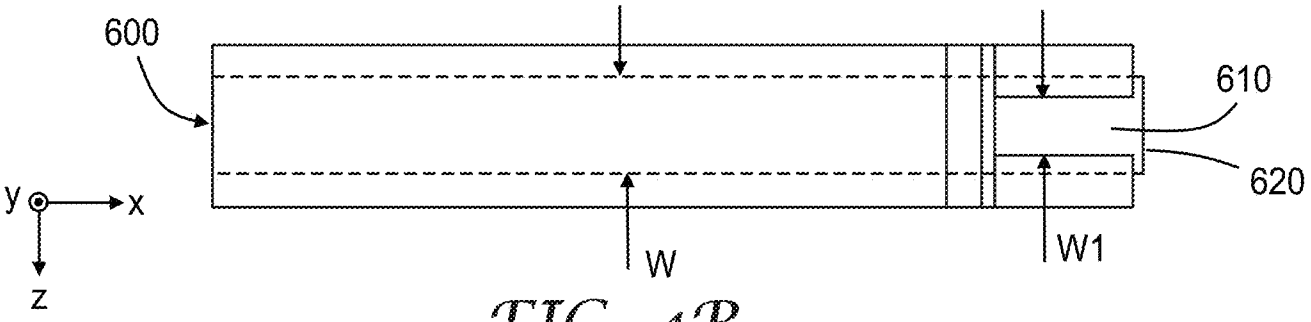
FIG. 4B is a schematic top plan view of an insulated conductor of the electrical cable of FIG. 4A.

FIG. 3 is a schematic cross-sectional view of electrical cable 171 including a plurality of substantially parallel insulated conductors 881 and including electrically conductive shield 493 which includes three separate portions. Each insulated conductor in the plurality of insulated conductors 881 includes an inner conductor 282 and an insulating layer 331 having a periphery 377. In the illustrated embodiment, the electrically conductive shield 493 surrounds each insulated conductor and the entire periphery 377 of each insulated conductor is encompassed by the electrically conductive shield 493. Electrical cable 171 includes insulating jacket 653 surrounding the electrically conductive shield 493. FIG. 4A is a schematic cross-sectional side view of electrical cable 2000 comprising a plurality of substantially parallel insulated conductors 600 extending along a length direction (x-direction, referring to the x-y-z coordinate system of FIG. 4A) of the cable 2000. FIG. 4B is a top plan view of an insulated conductor 600 of the electrical cable 2000. Each insulated conductor 600 comprises an electrically conductive inner conductor 700 co-extensive and covered with an insulating layer 800. In some embodiments, electrical cable 2000 includes an electrically conductive shield 900 substantially co-extensive with and surrounding each insulated conductor 600. In some embodiments, at least 70% of a periphery of each insulated conductor 600 is encompassed by a substantially co-extensive electrically conductive shield 900. Opposing major top and bottom sides 2100 and 2200 of the electrical cable 2000 are defined by laying the cable 2000 flat. For each insulated conductor 600, portions of the insulating layer 800 and the electrically conductive shield 900 are removed from the top side 2100 of the cable to expose a portion 610 of the inner conductor 700 of the insulated conductor 600, such that from a top plan view (see FIG. 4B), an average lateral width W1 of the exposed portion 610 of the inner conductor 700 is less than an average lateral width W of the inner conductor 700. Using a blade, such as a razor blade, to remove a portion of the electrically conductive shield 900 and insulating layer 800 can result in the average lateral width W1 being less than the average lateral width W.

The exposed portion 610 has a length 630 on the top side 2100 of the electrical cable 2000. A shorter portion of the insulated conductor 600 having a length 633 may optionally be exposed on the bottom side 2200 of the electrical cable 2000. The length 633 may be less than 0.5 mm or may be zero, for example. The exposed portion 610 of the inner conductor 700 comprises a first end 620 of the inner conductor 700 on a same first end 2300 of the cable 2000. The insulated conductor 600 is adapted to mate with an electrically conductive mating conductor 500 at the exposed portion 610 of the inner conductor 700.

In the illustrated embodiment, electrical cable 2000 includes layer 940, which may be or include and adhesive layer and/or an insulating substrate, between electrically conductive shield 900 and insulating layer 800 and includes electrically insulating jacket 960 adjacent the electrically conductive shield 900 opposite the insulated conductors 600.

Figure 5:
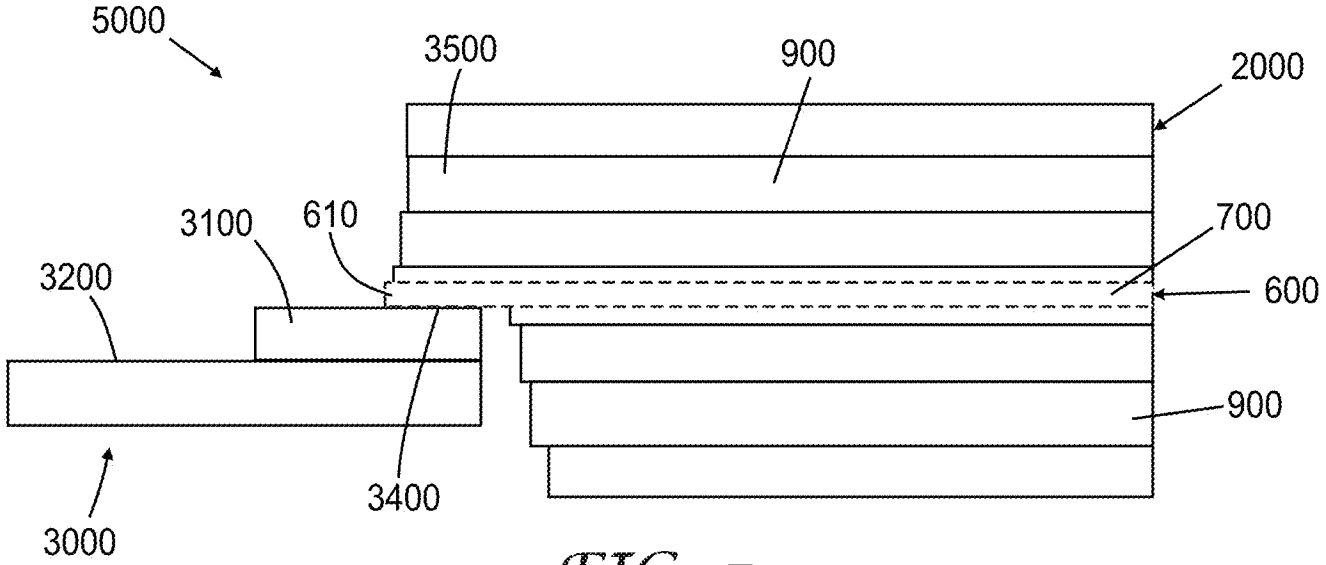
FIG. 5 is a schematic cross-sectional side view of an electrical cable assembly.

FIG. 5 is a schematic cross-sectional side view of electrical cable assembly 5000 including the electrical cable 2000 of FIG. 4A and a circuit board 3000 which includes a plurality of contact pads 3100 disposed on a major surface 3200 of the circuit board 3000. The exposed portion 610 of the inner conductor 700 of each insulated conductor 600 is attached to a corresponding contact pad 3100 of the circuit board 3000 at an attachment area 3400. The unremoved portions 3500 of the electrically conductive shield 900 at least partially shield the attachment area 3400. The contact pad 3100 is an electrically conductive mating conductor adapted to mate with the exposed portion 610 of the inner conductor 700. The exposed portion 610 of the inner conductor 700 can be attached to the attachment area 3400 using one or more of solder, an electrically conductive adhesive layer, PARIPOSER Interconnection Fabric available from PARICON Technologies Corp. (Taunton, Mass.), and mechanical clamping such as Zero Insertion Force (ZIF) or Low Insertion Force (LIF) technology. Suitable electrically conductive adhesive layers include anisotropic conductive films adhesives such as those available from 3M Company (St. Paul, Minn.), and include heat curable electrically conductive adhesive sheets having an adhesive layer and at least one electrically conductive portion configured to pass through the adhesive layer to make physical and electrical contact with an adherend when adhered under pressure and/or heat. Such heat curable electrically conductive adhesive sheets and related methods of bonding are described in PCT publications WO 02/20686 (Kawate et al.) and WO 2006/017037 (Kawate et al.) both of which are hereby incorporated herein by reference to the extent that they do not contradict the present description.

Figure 6:
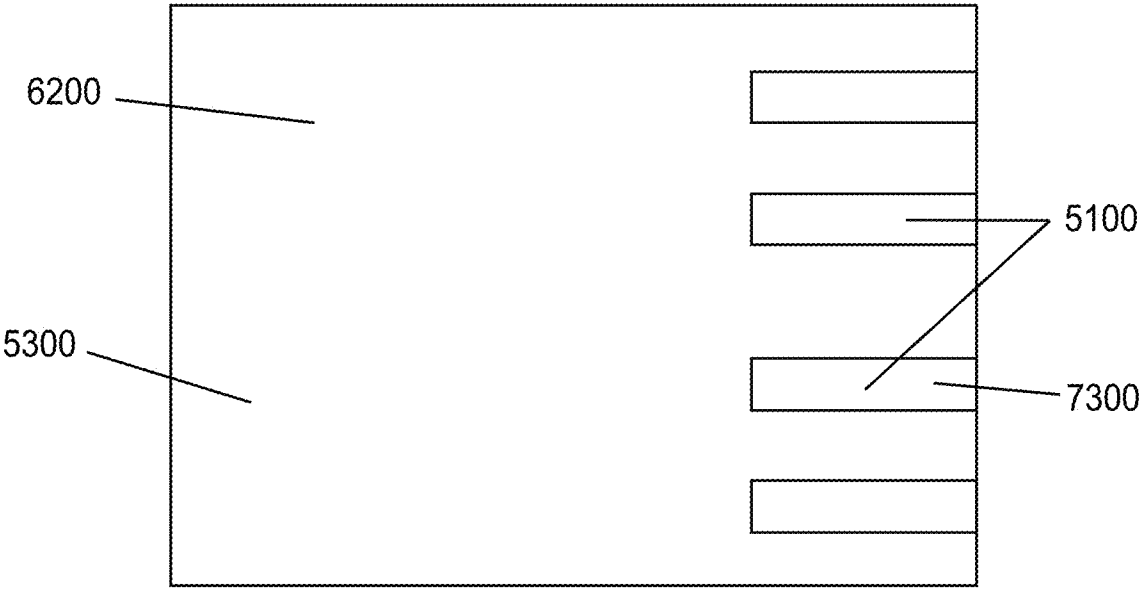
FIG. 6 is a schematic top view of a circuit board.

FIG. 6 is a schematic top view of circuit board 5300, which may correspond to circuit board 3000, and which includes a plurality of contact pads 5100 disposed on a major surface 6200 of the circuit board 5300. Each contact pad 5100 includes an attachment area 7300.

Figure 7:
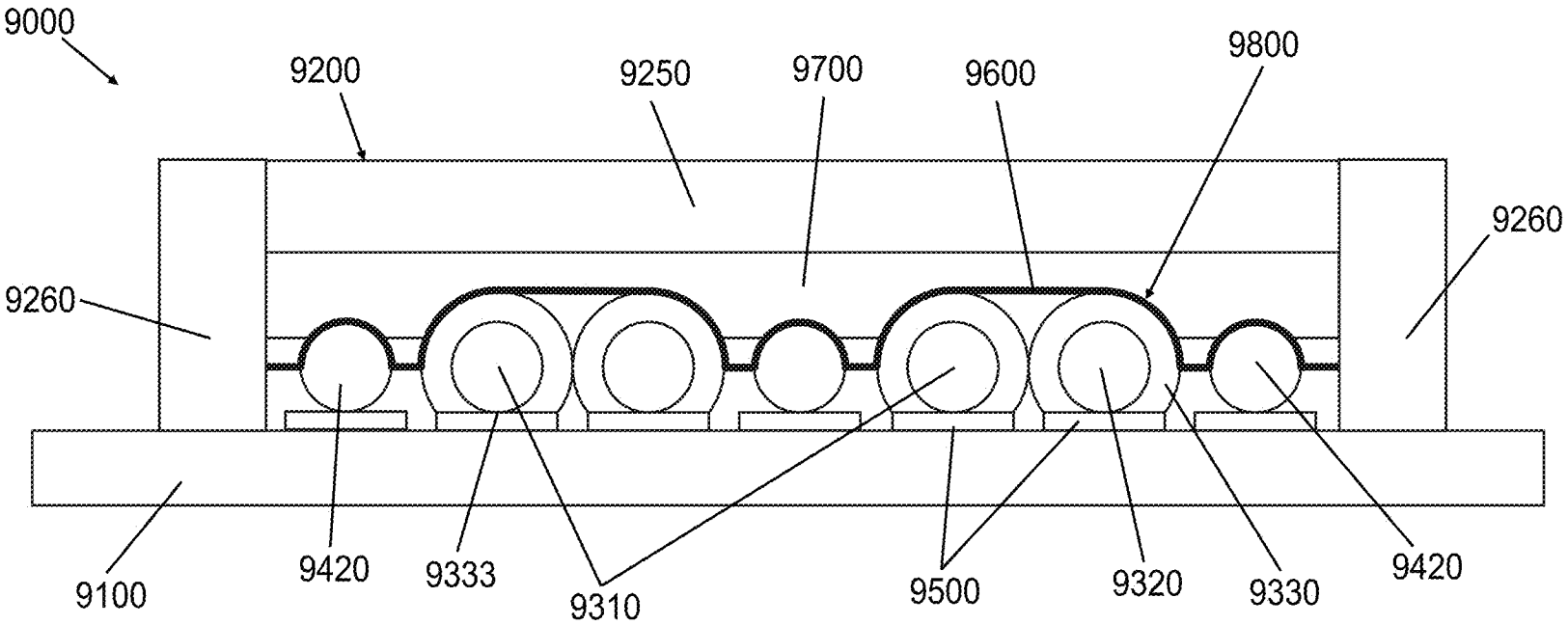
FIG. 7 is a schematic cross-sectional view of an electrical cable assembly.

FIG. 7 is a schematic cross-sectional view of electrical cable assembly 9000 including electrical cable 9800, which may correspond to any of the electrical cables described herein, and circuit board 9100 having a plurality of contact pads 9500. Electrical cable assembly 9000 includes frame 9200 having an upper portion 9250 disposed over the electrical cable 9800 and over the plurality of contact pads 9500 and at least one side portion 9260 extending from the upper portion 9250 and attached to the circuit board 9100. Electrical cable assembly 9000 may correspond to electrical cable assembly 5000 with the addition of frame 9200 used to attach the electrical cable 9800 to the circuit board 9100. The electrical cable 9800 includes a plurality of insulated conductors 9310, each having an inner conductor 9320, an insulating layer 9330 and exposed portions 9333 of the inner conductor 9320. Cable 9800 further includes an electrically conductive shield 9600 and a plurality of ground conductors 9420 which are in electrical contact with the electrically conductive shield 9600 and which do not include an insulating layer. Electrical cable assembly 9000 further includes at least one feature 9700 adapted to attach the exposed portion 9333 of the inner conductor 9320 of each insulated conductor 9310 to the corresponding contact pad in the plurality of contact pads 9500 of the circuit board 9100 by applying pressure to the electrical cable 9800 opposite the corresponding contact pad. In some embodiments, the at least one feature 9700 includes at least one compliant feature. In the illustrated embodiments, a single continuous feature 9700 is shown. In other embodiments, feature 9700 is a plurality of features. For example, a plurality of separated features may be used with each feature corresponding to an insulated conductor in the electrical cable 9800. The at least one feature 9700 may be or may include a compliant material such as an elastomer, a foam, or a material having a lower durometer than the frame 9200. In some embodiments, the at least one feature is not compliant, and the electrical cable 9800 includes a compliant layer (e.g., insulating layer 9330 or an insulating jacket).

In some embodiments, the inner conductors (e.g., inner conductor 200, 202, 282 or 700) in the plurality of insulated conductors (e.g., insulated conductors 100, 181, 881, or 600) of the electrical cables of the present description may include one or more ground conductors and the electrically conductive shield may be bonded to one or more of the ground conductors. The shield can be bonded to the ground conductors with an ultrasonic weld (e.g., a 40 kHz ultrasonic weld), for example. Such bonding can be utilized near one or both ends of the cable near a mating conductor as described in U.S. 62/155,599, filed May 1, 2015 and entitled "CONNECTOR ASSEMBLY", for example. This may be done in order for the electrically conductive shield to provide improved electromagnetic interference (EMI) shielding at low frequencies, and this can improve the performance of the electrical cable in single ended signaling applications.

The insulating layer (e.g., insulating layer 300, 301, 331, 800) covering the inner conductor of the plurality of insulated conductors can be formed around the inner conductors via extrusion, for example. In some cases, an insulating jacket may be extruded over the insulating layer. Suitable material for insulating layer and/or the insulating jacket include extrudable thermoplastics such as thermoplastic elastomer (TPE), polyolefin (PO) such as polyethylene (PE) and polypropylene (PP), polyvinyl chloride (PVC), polytetrafluoroethylene (PTFE), and fluorinated ethylene propylene (FEP), for example. The material chosen for the insulating layer may have a dielectric constant less than about 3.0, or less than about 2.5, and may have a minimum elongation of 50 percent.

The electrically conductive shield (e.g., electrically conductive shield 400, 490, 493, 900) of the electrical cables of the present description may be robustly bonded to the insulating layer so that the electrical cables can provide a desired electrical performance (e.g., a predetermined impedance (e.g., between 85 and 100 ohms for differential signaling or 50 ohms for single ended signaling) and a low attenuation (e.g., less than −3 db/m at 3 Ghz or less than −6 db/m at 3 Ghz)) that is robust in a broad range of typical use conditions which include bending, folding and varying temperature and humidity. The electrical cables may be used for one or more of differential signaling, single ended signaling, differential driven single ended signaling, and power.

The electrically conductive shield may be any type of film capable of providing electromagnetic shielding to the conductors of the cable. Suitable shielding films are known in the art (see, e.g., U.S. Pat. No. 9,064,612 (Gundel), which is hereby incorporated herein by reference to the extent that it does not contradict the present description). The shield may include metalized film, metal foil, braided copper (or other metal) or expanded copper (or other metal), for example. The shield may include metal foil (e.g., aluminum foil) laminated to a substrate or laminated between two substrates. Suitable substrates include polymeric substrates such as polyethylene terephthalate (PET). In some embodiments, the thickness and material choice (which determines a dielectric constant) of a substrate between a metal shielding layer and the insulating layer of the insulated conductors and/or the thickness and material choice of an adhesive between the metal shielding layer and the insulating layer may be selected to give a desired impedance. The electrical cable may have any useful impedance. For example, the impedance may be in the range of 40 to 110 ohms, or 50 to 105 ohms, or 80 to 105 ohms, or 85 to 100 ohms. In some embodiments, the impedance may be in a range of 40-60 ohms (e.g., about 50 ohms) for single ended applications. In some embodiments, the impedance may be in a range of 75-110 ohms, or 85 to 100 ohms for single differential applications.

The inner conductors (e.g., inner conductors 200, 202, 282, 700) may be wires adapted for maximum data transmission rates of at least 100 Mb/s, or at least 1 Gb/s, or at least 3 Gb/s, for example. An electrical cable assembly including the electrical cable terminated at a connector or a circuit board may be adapted for maximum data transmission rates of at least 100 Mb/s, or at least 1 Gb/s, or at least 3 Gb/s, for example. The wire gage may be in a range of 20 AWG to 34 AWG, or 26 to 31 AWG, for example. The conductors may be solid or stranded and may be made from copper, tin, silver, copper alloy with no plating, copper alloy with tin plating, copper alloy with gold plating, or copper alloy with silver plating, for example.

The following is a list of exemplary embodiments of the present description.

Embodiment 1 is an electrical cable comprising a plurality of substantially parallel insulated conductors extending along a length direction of the cable, each insulated conductor comprising an electrically conductive inner conductor covered with an insulating layer, such that when the electrical cable is laid flat defining opposing major top and bottom sides of the cable, for at least one insulated conductor in the plurality of insulated conductors, a longer first portion of the inner conductor of the at least one insulated conductor is exposed on the top side of the cable, and a shorter second portion of the inner conductor of the at least one insulated conductor is exposed on the bottom side of the cable, the longer first portion at least partially overlapping the shorter second portion, the inner conductor adapted to mate with an electrically conductive mating conductor at the exposed longer first portion of the inner conductor.

Embodiment 2 is the electrical cable of Embodiment 1, wherein the shorter second portion has a zero length.

Embodiment 3 is the electrical cable of Embodiment 1, wherein the at least one insulated conductor extends along the length direction of the cable between opposite ends of the at least one insulated conductor, the exposed longer first portion of the inner conductor of the at least one insulated conductor comprising one of the ends.

Embodiment 4 is the electrical cable of Embodiment 1, wherein the exposed longer first portion of the inner conductor of the at least one insulated conductor is at least 0.5 mm long.

Embodiment 5 is the electrical cable of Embodiment 1, wherein the exposed longer first portion of the inner conductor of the at least one insulated conductor is at least 1 mm long.

Embodiment 6 is the electrical cable of Embodiment 1, wherein the exposed longer first portion fully overlaps the exposed shorter second portion.

Embodiment 7 is the electrical cable of Embodiment 1, wherein the at least one insulated conductor extends along the length direction of the cable between a first end of the at least one insulated conductor at a same first end of the cable and an opposite second end of the at least one insulated conductor at a same opposite second end of the cable.

Embodiment 8 is the electrical cable of Embodiment 7, wherein the exposed longer first portion of the inner conductor of the at least one insulated conductor comprises the first end of the at least one insulated conductor.

Embodiment 9 is the electrical cable of Embodiment 1, further comprising an electrically conductive shield substantially co-extensive with the plurality of substantially parallel insulated conductors.

Embodiment 10 is the electrical cable of Embodiment 9, wherein at least 70% of a periphery of each insulated conductor is encompassed by the electrically conductive shield.

Embodiment 11 is the electrical cable of Embodiment 10, wherein each insulated conductor is surrounded by the electrically conductive shield.

Embodiment 12 is an electrical cable comprising a plurality of substantially parallel insulated conductors extending along a length direction of the cable, each insulated conductor comprising an electrically conductive inner conductor covered with an insulating layer, at least 70% of a periphery of each insulated conductor encompassed by a substantially co-extensive electrically conductive shield, such that when the electrical cable is laid flat defining opposing major top and bottom sides of the cable, for each insulated conductor, portions of the insulating layer and the conductive shield are removed from the top side of the cable to expose a portion of the inner conductor of the insulated conductor, such that from a top plan view, an average lateral width of the exposed portion of the inner conductor is less than an average lateral width of the inner conductor, the exposed portion of the inner conductor comprising a first end of the inner conductor on a same first end of the cable, the insulated conductor adapted to mate with an electrically conductive mating conductor at the exposed portion of the inner conductor.

Embodiment 13 is the electrical cable of Embodiment 12, wherein the exposed portion of the inner conductor is at least 0.5 mm long.

Embodiment 14 is the electrical cable of Embodiment 12, wherein the exposed portion of the inner conductor is at least 1 mm long.

Embodiment 15 is an electrical cable comprising a plurality of substantially parallel insulated conductors extending along a length direction of the cable, each insulated conductor comprising an electrically conductive inner conductor co-extensive and covered with an insulating layer, and an electrically conductive shield substantially co-extensive with and surrounding each insulated conductor, such that when the electrical cable is laid flat defining opposing major top and bottom sides of the cable, for each insulated conductor, portions of the insulating layer and the conductive shield are removed from the top side of the cable to expose a portion of the inner conductor of the insulated conductor, such that from a top plan view, an average lateral width of the exposed portion of the inner conductor is less than an average lateral width of the inner conductor, the exposed portion of the inner conductor comprising a first end of the inner conductor on a same first end of the cable, the insulated conductor adapted to mate with an electrically conductive mating conductor at the exposed portion of the inner conductor.

Embodiment 16 is the electrical cable of Embodiment 15, wherein the exposed portion of the inner conductor is at least 0.5 mm long.

Embodiment 17 is the electrical cable of Embodiment 15, wherein the exposed portion of the inner conductor is at least 1 mm long.

Embodiment 18 is an electrical cable assembly, comprising: a circuit board comprising a plurality of contact pads disposed on a major surface of the circuit board; and the electrical cable of any one of Embodiments 1 to 11, wherein the exposed longer first portion of the inner conductor of each insulated conductor is attached to a corresponding contact pad of the circuit board at an attachment area, and wherein the unremoved portions of the conductive shield at least partially shield the attachment area.

Embodiment 19 is the electrical cable assembly of Embodiment 18, further comprising:

a frame having an upper portion disposed over the electrical cable and at least one side portion extending from the upper portion towards the circuit board and attached to the circuit board; and at least one feature disposed between the upper portion of the frame and the electrical cable, the at least one feature adapted to attach the exposed longer first portion of the inner conductor of each insulated conductor to the corresponding contact pad of the circuit board by applying pressure to the electrical cable opposite the corresponding contact pad.

Embodiment 20 is the electrical cable assembly of Embodiment 19, wherein the at least one feature comprises at least one compliant feature.

Embodiment 21 is an electrical cable assembly, comprising: a circuit board comprising a plurality of contact pads disposed on a major surface of the circuit board; and the electrical cable of any one of Embodiments 12 to 17, wherein the exposed portion of the inner conductor of each insulated conductor is attached to a corresponding contact pad of the circuit board at an attachment area, and wherein the unremoved portions of the conductive shield at least partially shield the attachment area.

Embodiment 22 is the electrical cable assembly of Embodiment 21, further comprising:

a frame having an upper portion disposed over the electrical cable and at least one side portion extending from the upper portion towards the circuit board and attached to the circuit board; and at least one feature disposed between the upper portion of the frame and the electrical cable, the at least one feature adapted to attach the exposed portion of the inner conductor of each insulated conductor to the corresponding contact pad of the circuit board by applying pressure to the electrical cable opposite the corresponding contact pad.

Embodiment 23 is the electrical cable assembly of Embodiment 22, wherein the at least one feature comprises at least one compliant feature.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. An electrical cable comprising a plurality of substantially parallel insulated conductors extending along a length direction of the cable and an electrically conductive shield substantially co-extensive with the plurality of substantially parallel insulated conductors, each insulated conductor comprising an electrically conductive inner conductor covered with an insulating layer, the insulating layer of at least one insulated conductor in the plurality of insulated conductors being separated from the insulating layer of at least one other insulated conductor in the plurality of insulated conductors, such that when the electrical cable is laid flat defining opposing major top and bottom sides of the cable, for the at least one insulated conductor in the plurality of insulated conductors, a longer first portion of the inner conductor of the at least one insulated conductor is exposed on the top side of the cable, and a shorter second portion of the inner conductor of the at least one insulated conductor is exposed on the bottom side of the cable, the longer first portion at least partially overlapping the shorter second portion, such that from a top plan view, an average lateral width of the longer first portion of the inner conductor is less than an average lateral width of the inner conductor of the at least one insulated conductor, and such that in a cross-section of the at least one insulated conductor orthogonal to the length direction of the cable and through the longer first portion, a planar surface of each insulated conductor of the at least one insulated conductor comprises a surface of the longer first portion and surfaces of the insulating layer of the insulated conductor adjacent to, and on opposite sides of, the longer first portion, wherein the electrical cable is adapted to mate with a circuit board comprising a plurality of contact pads disposed on a major surface of the circuit board such that when the longer first portion of the inner conductor of each of the at least one insulated conductor is attached to a corresponding contact pad of the circuit board at an attachment area of the contact pad, the electrically conductive shield at least partially shields the attachment area.

2. The electrical cable of claim 1, wherein the shorter second portion has a length less than 0.5 mm.

3. The electrical cable of claim 1, wherein the at least one insulated conductor extends along the length direction of the cable between opposite ends of the at least one insulated conductor, the exposed longer first portion of the inner conductor of the at least one insulated conductor comprising one of the ends.

4. The electrical cable of claim 1, wherein the exposed longer first portion of the inner conductor of the at least one insulated conductor is at least 0.5 mm long.

5. The electrical cable of claim 1, wherein the exposed longer first portion of the inner conductor of the at least one insulated conductor is at least 1 mm long.

6. The electrical cable of claim 1, wherein the exposed longer first portion fully overlaps the exposed shorter second portion.

7. The electrical cable of claim 1, wherein the at least one insulated conductor extends along the length direction of the cable between a first end of the at least one insulated conductor at a same first end of the cable and an opposite second end of the at least one insulated conductor at a same opposite second end of the cable.

8. The electrical cable of claim 7, wherein the exposed longer first portion of the inner conductor of the at least one insulated conductor comprises the first end of the at least one insulated conductor.

9. The electrical cable of claim 1, wherein at least 70% of a periphery of the each insulated conductor is encompassed by the electrically conductive shield.

10. The electrical cable of claim 9, wherein the each insulated conductor is surrounded by the electrically conductive shield.

* * * * *